United States Patent [19]

Cozad

[11] Patent Number: 4,489,838

[45] Date of Patent: Dec. 25, 1984

[54] LOW DROOP MULTI-PART PENDANT SUPPORTED BOOM

[75] Inventor: Harley R. Cozad, Cedar Rapids, Iowa

[73] Assignee: FMC Corporation, Chicago, Ill.

[21] Appl. No.: 293,727

[22] Filed: Aug. 17, 1981

[51] Int. Cl.[3] ..... B66C 23/04; B66C 7/00; B66C 23/56

[52] U.S. Cl. ..... 212/264; 212/231; 212/227; 212/239; 212/261; 212/262; 212/268; 212/186

[58] Field of Search ..... 212/177, 188, 192–193, 212/211, 227, 230–239, 240, 255, 260, 262, 264, 266–268, 186

[56] References Cited

U.S. PATENT DOCUMENTS

| | | | |
|---|---|---|---|
| 548,375 | 10/1895 | Loveridge | 212/264 |
| 2,698,096 | 12/1954 | Hughes | 212/267 |
| 2,868,392 | 1/1959 | Poffenberger | 212/8 |
| 2,999,600 | 9/1961 | Gates | 212/55 |
| 3,072,265 | 1/1963 | Nickles | 212/239 |
| 3,194,413 | 7/1965 | Landry | 212/264 |
| 3,308,967 | 3/1967 | Barkley et al. | 212/55 |
| 3,371,799 | 3/1968 | Brownell et al. | 212/35 |
| 3,398,492 | 8/1968 | Nansel | 52/115 |
| 3,465,899 | 9/1969 | Reuter et al. | 212/267 |
| 3,534,867 | 10/1970 | Johnston et al. | 212/264 |
| 3,727,359 | 4/1973 | Vonck | 52/121 |
| 3,842,985 | 10/1974 | Svede | 212/267 |
| 3,856,151 | 12/1974 | Lamer | 212/55 |
| 4,010,852 | 3/1977 | Goss et al. | 212/262 |
| 4,053,058 | 10/1977 | Jensen et al. | 212/8 R |
| 4,156,331 | 5/1979 | Lester et al. | 52/115 |
| 4,352,434 | 10/1982 | Poock | 212/230 |
| 4,363,413 | 12/1982 | Gyomrey | 212/267 |

FOREIGN PATENT DOCUMENTS

| | | | |
|---|---|---|---|
| 1803820 | 9/1970 | Fed. Rep. of Germany | 212/264 |
| 2040938 | 3/1971 | Fed. Rep. of Germany | 212/230 |
| 1122764 | 8/1968 | United Kingdom | 212/231 |
| 391046 | 10/1971 | U.S.S.R. | 212/267 |

*Primary Examiner*—Trygve M. Blix
*Assistant Examiner*—R. B. Johnson
*Attorney, Agent, or Firm*—A. J. Moore; R. C. Kamp; R. B. Megley

[57] ABSTRACT

A telescopic boom is disclosed which is pivotally supported by its base section for movement about a horizontal axis. The boom is supported by a live mast through multi-part pendant lines, which pendant lines are each reeved over sheaves attached to the boom at the forward end of the base section and at the forward end of another boom section to support the boom at a plurality of points forwardly of the live mast. The forward end of each pendant is preferably received within the boom over sheaves journaled on the cylinder case of a boom extending ram and on selected sections of the boom. The multi-part pendant supported boom reduces boom droop caused by extension of the boom approximately 50% of that of a boom supported at a single point by each pendant line.

1 Claim, 6 Drawing Figures

LOW DROOP MULTI-PART PENDANT SUPPORTED BOOM

CROSS REFERENCE TO RELATED APPLICATIONS

The present application is related to several U.S. applications all of which are assigned to the assignee of the present invention, and were filed on the indicated date or on even date herewith. The applications are as follows:

Poock application Ser. No. 145,529 which was filed on May 1, 1980 entitled PENDANT SUPPORTED HYDRAULIC EXTENSIBLE BOOM.

Rathe et al application Ser. No. 293,728 filed on Aug. 17, 1981 and issued on Oct. 5, 1982 as U.S. Pat. No. 4,352,434 entitled EXTENSIBLE BOOM WITH MANUAL STORED IN BASE.

Rathe application Ser. No. 293,729 filed on Aug. 17, 1981 and entitled COUPLING AND LATCHING MECHANISM FOR EXTENSIBLE BOOM.

BACKGROUND OF THE INVENTION

1. Field of the Invention

The present invention relates to a crane having a pendant supported boom; and more particularly relates to an extensible boom that is supported by at least one pendant which is supportively connected to the boom at a plurality of locations forwardly of the boom pivot axis for minimizing boom droop and boom friction during extension and retraction as compared to a cantilevered telescopic boom.

2. Description of the Prior Art

The pendant supported boom of the present invention is somewhat similar to that disclosed in U.S. Poock application Ser. No. 145,529 which was filed on May 1, 1980 and issued as U.S. Pat. No. 4,352,434 which is assigned to the assignee of the present invention. The disclosure of the Poock application is incorporated by reference herein.

It is also well known in the art to extend and retract telescopic booms with one or more hydraulic rams.

SUMMARY OF THE INVENTION

The term "boom droop" as used in the specification and claims, refers to the angle the boom pivots downwardly about its horizontal pivot axis in response to extending the boom from its retracted position.

The low droop, pendant supported boom of the present invention includes a multi-section telescopic boom having a base section pivoted about a horizontal axis to the upper works of the crane. The boom is preferably extended and retracted by one hydraulic cylinder aided by a portion of at least one fixed length pendant line reeved around sheaves within the boom and having one end anchored to the outer or forward end of the base section. Each pendant line includes at least two forwardly directed portions trained around a sheave on the upper end of a live mast and around external sheaves supportively connected to the forward end portions of two different boom sections.

Since each pendant line is attached to and supports the boom at two or more points spaced forwardly from the boom pivot axis, the tendency of the boom to bend is reduced and, accordingly, less force is required to extend and retract the boom. When the boom is being extended, the amount of each pendant line paid out from within the boom due to extension is, of course, moved externally of the boom and is exactly equal to the linear distance the boom is extended. When the boom is elevated to a predetermined angle and is extended, the two forwardly directed boom supported portions are angled relative to the axis of the boom, and thus their angles relative to the boom are constantly changing during extension. Since the paid out portion of each pendant line during extension is not parallel but is at an angle to the boom axis, the outer end of the boom will pivot downwardly or "droop" due to extension of the boom.

In the illustrated preferred embodiment of the invention two parts of each pendant are oriented in a forwardly extending direction relative to the mast. It has been found that in the preferred embodiment the boom droop due to extension is reduced about 50 percent as compared to the droop of a boom having only one portion of each pendant line supporting the boom. Thus, routing each pendant back to the forward end of the base section as described hereinafter creates in effect two parts of pendant line which considerably reduces boom droop during extension and also decreases pendant line forces.

It will be understood that pendant parts in excess of two parts extending forwardly of the live mast define a multi-part pendant line which further reduces boom droop due to extension.

DESCRIPTION OF THE PREFERRED EMBODIMENT

Figure 1:
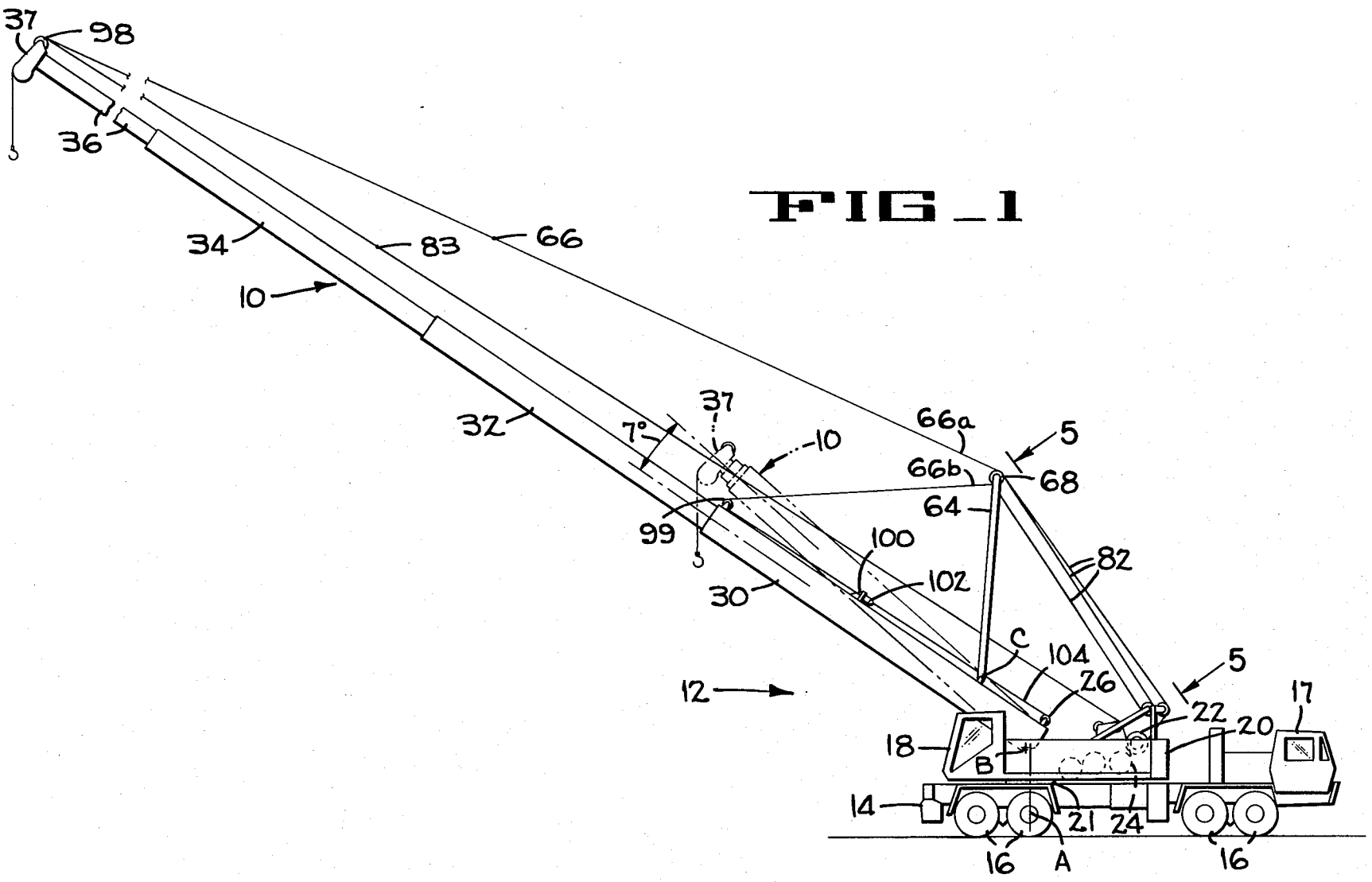
FIG. 1 is a diagrammatic side elevation of a machine incorporating the pendant supported boom with the multi-part pendant line of the present invention, said boom being shown fully retracted in dotted lines to illustrate the boom droop due to extension.

The low droop, multi-part pendant supported boom 10 (FIG. 1 and 2) of the present invention is illustrated as being the boom of a mobile crane 12 although it will be understood that the invention is not limited to a crane boom.

The crane 12 is illustrated as a self-propelled truck crane having a lower works or chassis 14 supported on wheels 16 for movement from place to place under the control of an operator in a cab 17. An upper works 20, includes a second cab 18, and is mounted on the chassis by a bearing 21 for rotation about a vertical axis A. The upper works supports the boom 10 for pivotal movement about a horizontal axis B. The upper works 20 also carries power means (not shown) which drives a hydraulic pump P (shown only in FIG. 6), a boom hoist winch or drum 22 (FIG. 2), a load hoist drum 24, one or more pendant take-up drums 26, and other standard components of the crane.

The boom 10 is a telescopic boom which includes at least two telescopic sections. The illustrated boom preferably includes a base section 30 pivoted to the upper works about the horizontal axis B, a manual section 32 slidably received in the base section 30, a mid section 34 slidably received in the manual section 32, and a tip section 36 which is slidably received in the mid section 34 and includes head machinery 37 on its outer end. The boom 10 is preferably extended and retracted by a single hydraulic ram 38 aided by a pair of extend-retract cables 40 (only one being shown in FIG. 3). The manual section 32 is selectively locked in a retracted position or in a selected one of a plurality of extended positions by lock pins 42 or the like which, extend through mating holes in the manual and base sections. Also, second lock means such as a pin (not shown) which extends through holes 44,45 is provided to lock the manual to the mid section when the manual is to be extended.

Figure 3:
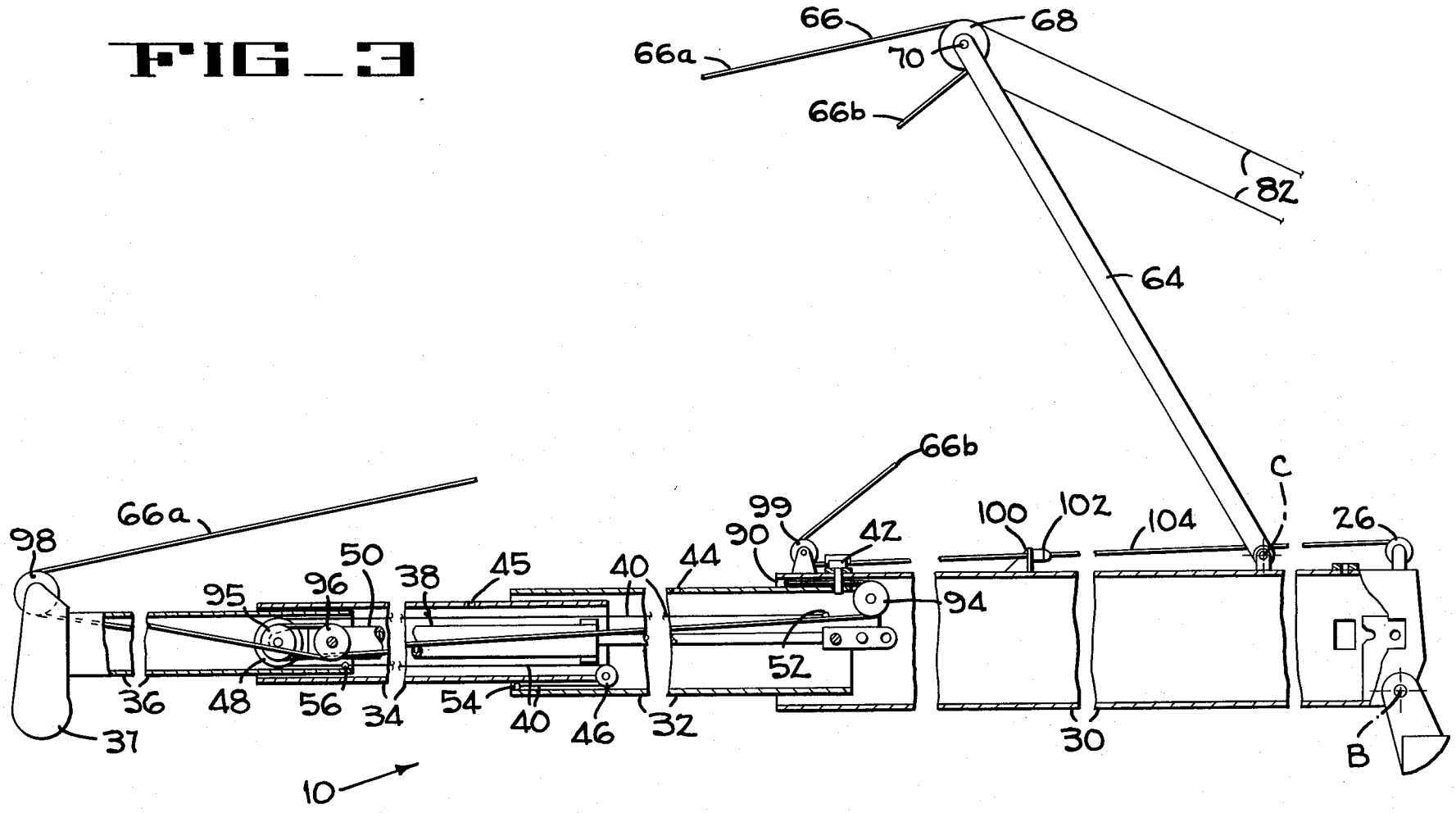
FIG. 3 is an enlarged diagrammatic vertical section of the telescopic boom of FIG. 1 when extended, certain parts being cut away; said view illustrating the preferred single hydraulic ram and the pendant system within the boom for extending and retracting the boom.

As best shown in FIG. 3, each extend-retract cable 40 is trained over sheaves 46,48 journaled on the inner end of the mid section 34 and on the outer end of the cylinder case 50 of the ram 38. The ends of each extend-retract cable 40 are anchored to the inner and outer ends of the manual section 32 at 52,54, respectively, and an intermediate portion of the cable 40 is anchored to the inner end of the tip section 36 at 56.

Figure 2:
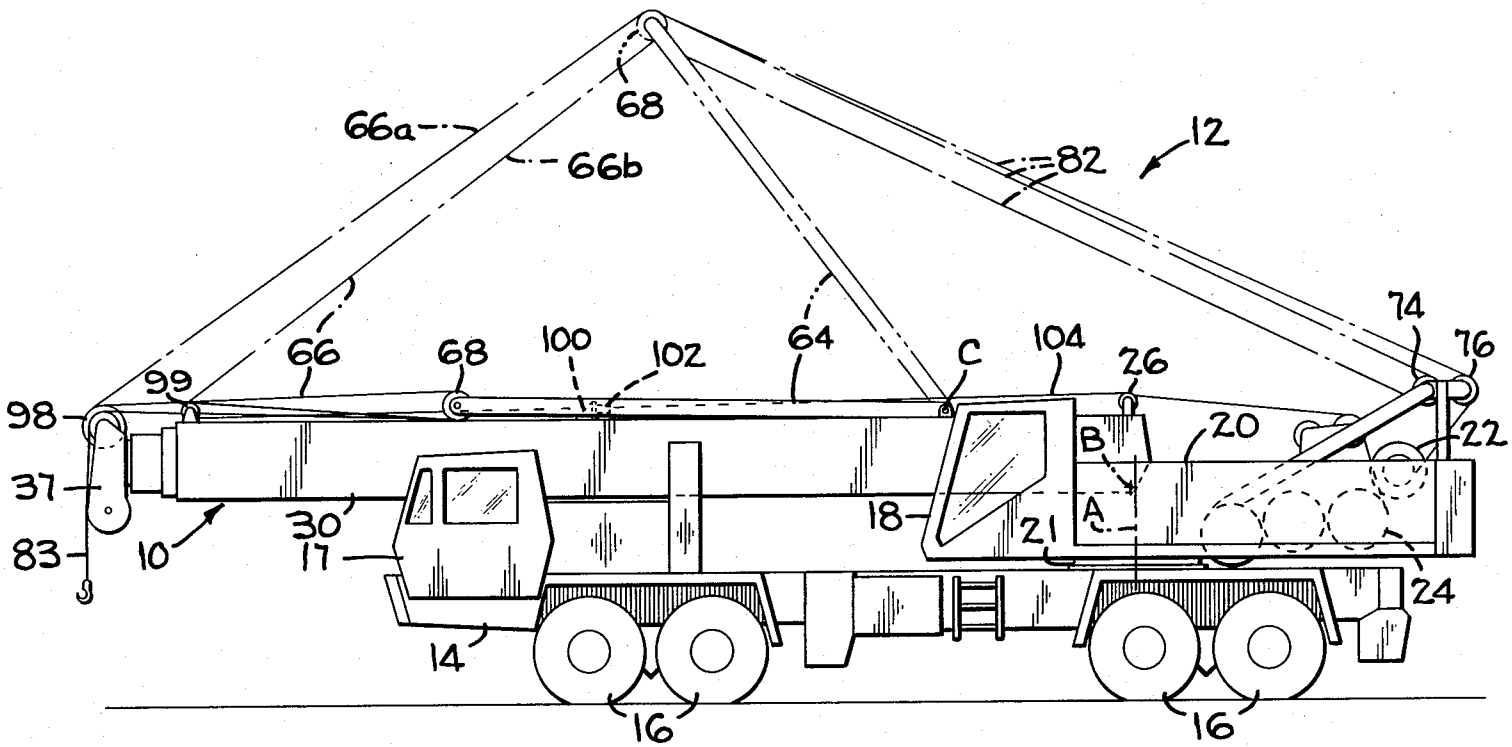
FIG. 2 is an enlarged diagrammatic side elevation of the crane with its boom and live mast retracted and shown in transport position in solid lines, and with its live mast and pendants shown in boom supporting position in phantom lines.

A live mast 64 is connected to the base section 30 of the boom 10 for pivotal movement about horizontal axis C between an upright boom supporting operative position (FIG. 1), and a substantially horizontal transport position shown in solid lines in FIG. 2.

Figure 5:
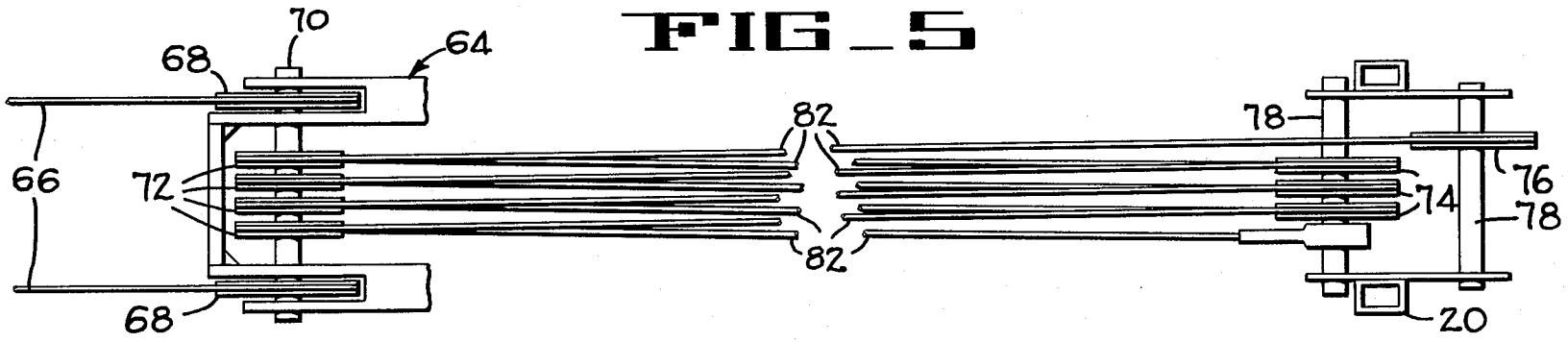
FIG. 5 is a view taken in the direction of arrows 5—5 of FIG. 1 illustrating the boom hoist cable arrangement.

As illustrated in FIG. 5, two side by side pendant lines 66 are provided and are each trained around a sheave 68 journaled on a shaft 70 secured to the upper end of the mast 64. A plurality of boom hoist sheaves 72 are also journaled on the shaft 70 while other hoist sheaves 74 and 76 are journaled on shafts 78,80 secured to the upper works 20. A boom hoist line 82 (FIGS. 2 and 5) has one end anchored to the shaft 78 and is trained around the sheaves 72,74 and 76 as best shown in FIG. 5. The other end of the boom hoist line 82 is wound upon the boom hoist drum 22 (FIG. 2) which is controlled by the operator to pivot the mast 64 between its transport position and its upright operative position, and to then lift the boom 10 by means of the pendant lines 66 between its horizontal transport position (FIG. 2) and a range of upright working positions which approach, but do not reach the vertical position. The load (not shown) being carried by the boom is supported by a load line 83 (FIGS. 1 and 2) trained around the load hoist drum 24 and the head machinery 37 in the usual manner.

As mentioned above and illustrated in FIG. 5, two parallel pendant lines are used in the preferred embodiment. However, for simplifying the description to follow, the pendant lines 66 will occasionally be described as though only one pendant line is being used.

As indicated previously, the term "boom droop" as used in the specification and claims, refers to the angle the boom pivots about horizontal axis B in response to extending the boom while the boom hoist winch 22 is held in stationary, i.e., is not paying out or taking up the boom hoist line 82. The "boom droop" angle between full retraction and full extension of the boom in the illustrated embodiment is only about 7° (FIG. 1). This amount of droop is about 50% of the droop of a pendant supported boom of the type disclosed in the aforementioned Poock application which is supported by only one part of the pendant near the forward end of the boom. The boom 10 and the Poock boom when fully extended are about 120 feet long. It will also be understood that the term "boom droop" does not include bending of the boom caused by heavy loads nor does it include droop caused by stretching of the pendant line.

Figure 4:
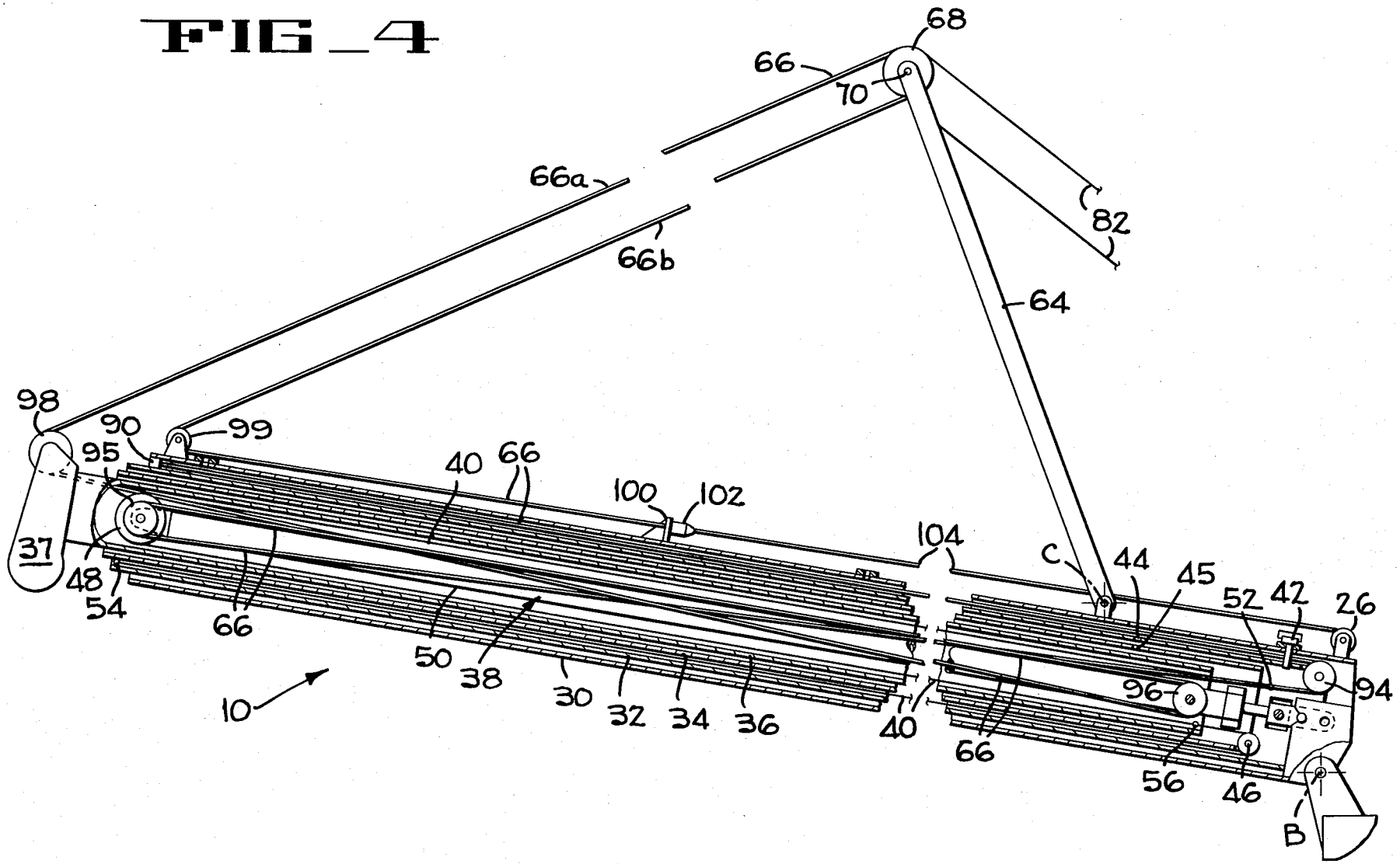
FIG. 4 is a vertical section similar to FIG. 3 but with the boom fully retracted.

As best shown in FIGS. 3 and 4, each pendant line includes an internal portion within the boom and an external portion outside of the boom. One end of each pendant line 66 is anchored to the forward end of the base section 30 at 90. The internal portion of the pendant line is then trained around a sheave 94 journaled on the inner end of the manual section 32, around a sheave 95 journaled on the cylinder case 50, around a sheave 96 journaled on the inner end of the tip section 36, and around an external sheave 98 journaled on the outer end of the tip section 36. The outer portion of each pendant line 66 is then trained from the sheave 98 around the live mast sheave 68, and around an external sheave 99 journaled on the outer end of the base section 30. Each pendant line 66 has its other end anchored to the base section 30 by a pendant stop or abutment 100 that is secured to the base section 30 and a pendant anchor mechanism 102 which is rigidly secured to the pendant line 66 and engages the abutment 100 when the pendant line 66 is in its boom supporting position.

A pendant take-up line 104 (FIGS. 1 and 3) is connected to the anchor mechanism 102 and is wound around the take-up drums 26 which serve to maintain tension on the pendant line 66 when the live mast 64 is in or is moving between its working position and tranport position.

It will be noted that each pendant 66 is a fixed length pendant since it is anchored to the base section at 90 and to the anchor mechanism 102 which engages the abutment 100 when supporting the boom. It will also be noted that a substantial length of each pendant is taken up within the boom 10 of the preferred embodiment when the boom is retracted, and is paid out of the boom when the boom is extended.

It has been determined that when the boom supporting winch or drum 22 is locked from rotation and the boom is being extended, insufficient line is paid out from within the boom 10 to prevent the tip of the boom from drooping, i.e., pivoting downwardly about axis B because of the angular relationship of the pendant lines and the longitudinal axis of the boom. When retracting the boom under the above conditions, the opposite results occur, i.e., the boom tip pivots upwardly. It is, of course, desirable that such boom droop (or raise) be reduced to a minimum so that the operator does not have to simultaneously operate both the boom winch and the hydraulic ram 38. An important feature of the invention is that each pendant line 66 is supportively connected to the boom at a plurality of points forwardly of the mast 64 and forwardly of the boom pivot axis B by pendant parts 66*a* and 66*b*. This is accomplished in the preferred embodiment by supportively attaching the pendants 66 to the boom at two points defined by the sheaves 98 and 99. Thus, the boom 10, as illustrated in FIG. 1, is not only supported at its pivot axis B and at the outer end of the tip section 36, but is also supported by the pendant lines 66*b* at the outer end of the base section 30. This manner of supporting the boom has several advantages compared to known pendant supporting systems such as that disclosed in assignee's aforementioned Poock application.

One advantage is that it divides or reduces the load in the pivot lines, thus increasing boom capacity; or, alternatively, permits the use of smaller pendant lines if the pendant line is the limiting factor or weakest supporting component in the system.

Another advantage is that the boom droop is reduced 50%, or from approximately 14° in the prior art system disclosed in the aforementioned Poock application to about 7° in the embodiment shown in FIG. 1 as previously mentioned. In this regard, it will be noted that the boom supporting portions or parts 66*a* and 66*b* of each pendant line 66 extend forwardly from the live mast 68 (FIG. 4) and are substantially parallel when the boom is fully retracted. Thus, a portion of the difference in pendant length externally and internally of the boom is taken up by the two parts 66*a* and 66*b* of each pendant line rather than by the single part as in the prior art.

As mentioned previously, the live mast 64 is moved between its raised boom supporting position as illustrated in phantom lines in FIG. 2 and its transport position shown in solid lines in FIG. 2. It is apparent that each pendant line 66 will become slack when the live mast is moved between its transport and working positions unless the take-up and pay out pendant line drums 26 (FIG. 3) maintains the take-up portion 104 of each line 66 tensioned.

Figure 6:
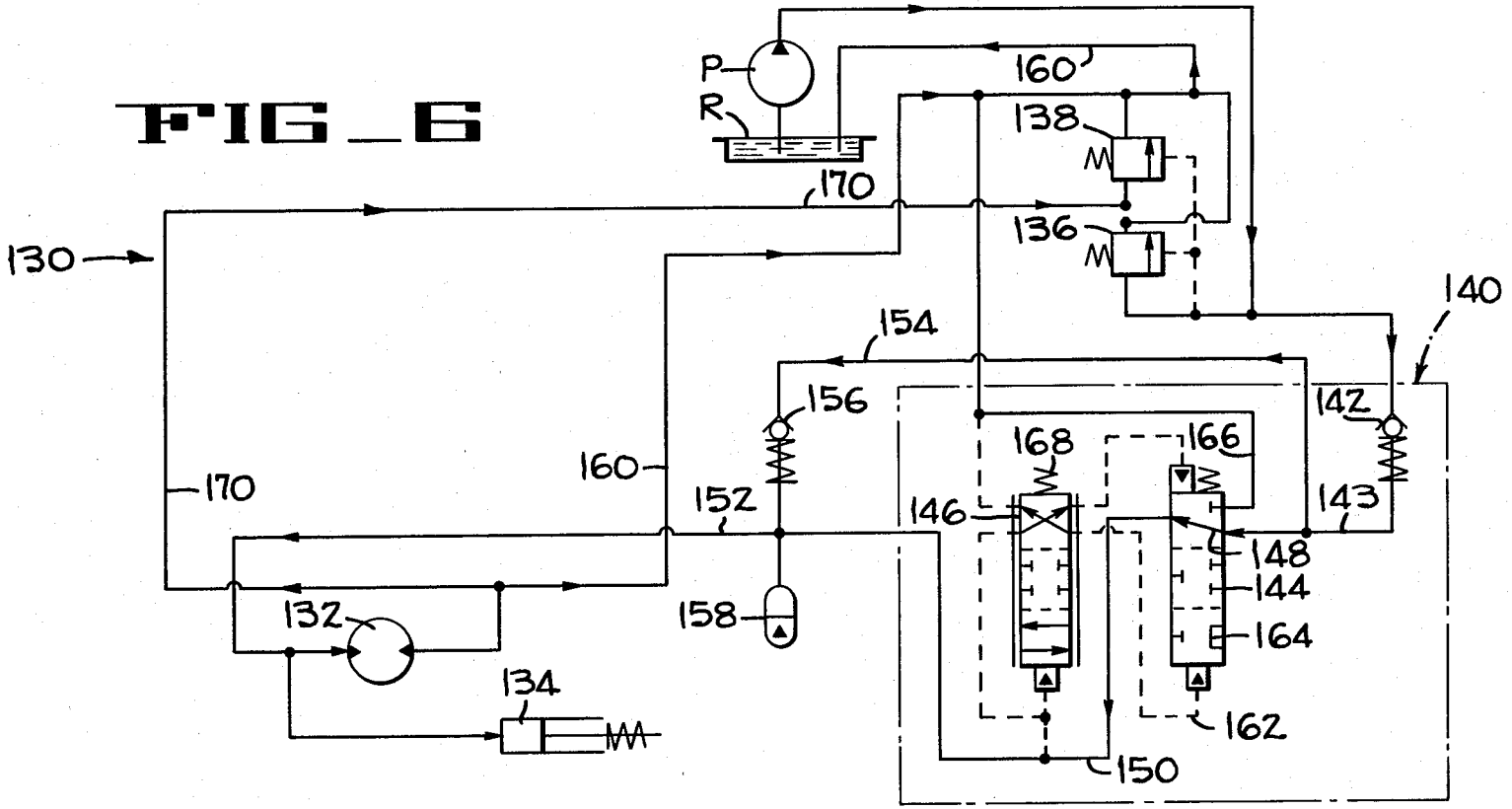
FIG. 6 is a simplified hydraulic system for the pendant take-up winch.

A simplified hydraulic circuit 130 for the pendant winch or take-up drums 26 is illustrated in FIG. 6. The circuit includes a hydraulic motor 132 and a spring set - hydraulically released brake 134 connected to the pendant take-up drums 26 (FIG. 4). The hydraulic pump P and a reservoir R are mounted on the lower works 14 (FIG. 2) and direct fluid through a well known rotating joint (not shown) to other components of the circuit on the upper works 20 (FIG. 2) in the direction indicated by the arrows in FIG. 6.

The pump P provides fluid pressure of about 1000 psi at rated capacity and will return fluid to the reservoir R through pilot operated relief valve 136,138 in the event the pressure in the system reaches about 1250 psi.

The pendant take-up operation occurs when the live mast 64 is being lowered from its raised operative position (FIG. 1) to its lowered transport position shown in solid lines in FIG. 2 by the hoist drum 22 (FIG. 2) which is controlled by the operator to pay-out line 82 from the drum 22. At this time, high pressure fluid flows into an unloader 140 which includes a check valve 142, a pilot operated first valve 144, and a pilot operated second valve 146. The fluid flows from the pump P through the check valve 142, through an inlet conduit 143, through a slant passage 148 in valve 144 and through an internal conduit 150 in the unloader 140 into an external conduit 152. Also, at this time, fluid flows through a by-pass conduit 154 and check valve 156 into external conduit 152 which communicates with a surge chamber 158. The fluid in the conduit 152 enters the motor 132 and brake 134, which brake is released allowing the motor to rotate the drums 26 (FIG. 3) in a pendant take-up direction. The hydraulic fluid discharged from the motor 132 returns to the reservoir R through conduit 160.

When the mast has been lowered and the desired tension on the pendant lines is reached, the hydraulic motor 132 will stop causing a pressure increase to about 1050 psi in the unloader 140. The increase in pressure from line 150 will act on the valves 144,146 through pilot lines (indicated in dotted lines) thereby shifting the core of valve 146 from the illustrated cross passage position to the parallel passage position and directing pilot pressure through pilot conduit 162 shifting the core of valve 144 from its illustrated slant passage position to the position wherein a wide passage 164 in the core of valve 144 establishes flow communication between the conduit 143 and a conduit 166 which directs the hydraulic fluid to the reservoir R through conduits 166 and 160. Thereafter, if the pressure in conduit 150 of the unloader drops to about 900 psi in response to stopping the pump P, a force applied by a spring 168 will overcome the pilot pressure acting on the valve 146 thereby returning the valve 146 to its illustrated cross passage position thus piloting the valve 144 to its illustrated slant passage position. When at this low pressure of about 900 psi the sail spring of the brake 134 holds the take-up drum 26 (FIG. 4) from rotation.

When the live mast 64 is to be moved from its lowered transport position to its raised operative position, the pump P is then started and the boom hoist winch 22 (FIG. 2) is actuated by the operator to raise the mast and thereafter to raise the boom. Raising the mast 64 by the more powerful boom hoist winch 22 will overpower the hydraulic motor 132 causing it to reverse its direction of rotation and act as a pump when the pendant take-up winch or drums 26 pay out pendant line 66. When the hydraulic motor 132 is acting as a pump as above described, hydraulic pressure tending to drive the motor 132 exceeds about 1250 psi thereby piloting both relief valves 136,138 open. Hydraulic fluid from the motor 132 then returns to the reservoir R through conduit 170 and through open relief valve 138.

Assignee's three cross referenced applications disclose and claim different types of structures for extending and retracting the boom sections, and different types of structures for locking a manual section in desired position. Reference may be had to the cross referenced Rathe and Rathe et al applications for a more detailed discussion of the preferred means for controlling the length of the boom 10.

Although the preferred embodiment of the present invention discloses a boom which is extended and retracted by a single hydraulic cylinder with a boom supporting pendant partially disposed within the boom it will be understood that the pendant supporting system of the present invention is broad enough to cover booms with other extend-retract power means. For example, the invention is broad enough to cover a boom that is extended and retracted by pendant portions within the boom that are driven by two hydraulic cylinders, or by a winch in a manner well known in the art. The boom droop of such extensible two-part pendant supported booms would likewise be about 50% of that of an equivalent one part pendant supported boom that is supported by each pendant only at one point forward of the horizontal pivot axis of the boom.

Also, the invention is broad enough to cover a hydraulically extensible boom wherein the pendant is not trained around sheaves within the boom but has its forward end attached to an external point on the boom. In this case, the droop of the two part pendant supported boom would still be about 50% of that of a boom supported by each pendant line only at one point forward of the pivot axis of the boom. It is apparent, however, that the angle of droop would be considerably larger than the 7° droop of the preferred embodiment.

From the foregoing description, it is apparent that the low droop pendant supported boom with multi-part pendant lines of the preferred embodiment of the present invention minimizes boom droop by about 50% in response to extension of the boom and minimizes raising of the boom about 50% in response to retraction of the boom. Also the boom is supported at a plurality of positions forward of its pivot point by each pendant line for reducing the load in the pendant lines. In addition, the boom also reduces compression loading in the booms extension cylinder, which in turn reduces the size of the cylinders required for handling a predetermined load thereby optimizing the boom weight.

Although the best mode contemplated for carrying out the present invention has been shown and described it will be apparent that modification and variation may be made without departing from what is regarded to be the subject matter of the invention.

What is claimed is:

1. In a crane or the like having an extensible boom formed from at least three telescoping boom sections each having a forward and an inner end and including a base section pivoted about a horizontal axis, power means including a single hydraulic ram operatively connected to different boom sections for selectively extending and retracting the boom, a live mast pivoted to the boom forwardly of said axis, pendant supporting sheaves journaled on the upper end of said mast, a pair of fixed length pendants trained around said sheaves, each pendant having first and second boom supporting parts extending forwardly of said mast sheaves with said first boom supporting parts being supportively connected to the forward end of said base section and said second pendant parts being supportively connected to the forward end of another of said boom sections, each pendant having an internal portion disposed within said boom with one end anchored to the forward end of said base section, sheaves journaled on the outer end of said ram and on the inner ends of two of said at least three boom sections with said internal portion of said pendants trained thereover, each fixed length pendant having an anchor mechanism rigidly secured thereto externally of said boom, abutment means secured to said base section which engage an anchor mechanism on said pendants when said pendants are supporting said boom in an upright position, and first power means for moving said mast between a substantially horizontal transport position supported on said base section and an upright boom supporting position and for thereafter pivotally supporting said boom about said horizontal axis, said boom being caused to droop in response to being extended and in response to said internal portion of each pendant being trained over the sheaves within said boom, said first and second boom supporting parts which extend forwardly of the mast sheaves being effective to reduce said boom droop about 50% in comparison to a boom supported by pendants at only one point near the forward end of said boom, and second power means being powered by hydraulic fluid and being connected to said pair of pendants for moving said anchor mechanism away from said abutment mechanism for maintaining said pair of pendants taut when said first power means is lowering said live mast into said transport position, said second power means being less powerful than said first power means and being overpowered by said first power means when said first power means is activated to raise said live mast from said transport position to said boom supporting position.

* * * * *